US010883196B2

(12) United States Patent
Schrempf et al.

(10) Patent No.: US 10,883,196 B2
(45) Date of Patent: Jan. 5, 2021

(54) CELLULOSE FIBER

(71) Applicant: LENZING AKTIENGESELLSCHAFT, Lenzing (AT)

(72) Inventors: Christoph Schrempf, Bad Schallerbach (AT); Kurt Christian Schuster, Vöcklabruck (AT); Hartmut Rüf, Schörfling (AT); Heinrich Firgo, Vöcklabruck (AT); Karl Michael Hainbucher, Schörfling (AT)

(73) Assignee: Lenzing Aktiengesellschaft, Lenzing (AT)

( * ) Notice: Subject to any disclaimer, the term of this patent is extended or adjusted under 35 U.S.C. 154(b) by 0 days.

(21) Appl. No.: 15/108,713

(22) PCT Filed: Dec. 22, 2014

(86) PCT No.: PCT/EP2014/079043
§ 371 (c)(1),
(2) Date: Jun. 28, 2016

(87) PCT Pub. No.: WO2015/101543
PCT Pub. Date: Jul. 9, 2015

(65) Prior Publication Data

US 2016/0326671 A1 Nov. 10, 2016

(30) Foreign Application Priority Data

Jan. 3, 2014 (EP) ..... 14150132

(51) Int. Cl.
*D01F 2/00* (2006.01)

(52) U.S. Cl.
CPC ..... *D01F 2/00* (2013.01)

(58) Field of Classification Search
CPC ..... D01F 2/00; D10B 2201/00
See application file for complete search history.

(56) References Cited

U.S. PATENT DOCUMENTS 4,246,221 A 1/1981 McCorsley, III
5,409,532 A 4/1995 Astegger et al.
(Continued)

FOREIGN PATENT DOCUMENTS

AT 506268 A1 7/2009
CN 1681978 A 10/2005
(Continued)

OTHER PUBLICATIONS

Josef Schruz & Jurgen Lenz, "Investigations on the Structure of Regenerated Cellulose Fibers", Macromolecular Symposia, vol. 83, Issue 1, (May 1994) pp. 273-289.
(Continued)

*Primary Examiner* — Elizabeth C Imani
(74) *Attorney, Agent, or Firm* — Venable LLP

(57) ABSTRACT

The present invention relates to a fiber of the Lyocell type which has a titer of from 0.8 dtex to 3.3 dtex and is characterized by the following relationships:

Höller factor F2≥1, preferably ≥2
Höller factor F1≥−0.6
Höller factor F2≤6 and
Höller factor F2 minus 4.5*Höller factor F1≥1, preferably ≥3.

The fiber according to the invention displays a specific combination of properties with regard to the Höller factors, the flexibility and the abrasion resistance within a planar assembly. Hence, the fiber shows a behavior more similar to viscose and can be processed in the textile chain according to viscose standard methods.

9 Claims, 2 Drawing Sheets

(56) References Cited

U.S. PATENT DOCUMENTS

| | | | |
|---|---|---|---|
| 5,540,874 | A | 7/1996 | Yamada et al. |
| 5,543,101 | A | 8/1996 | Ruf et al. |
| 5,589,125 | A | 12/1996 | Zikeli et al. |
| 5,601,771 | A | 2/1997 | Ruf |
| 5,618,483 | A | 4/1997 | Weigel et al. |
| 5,650,112 | A | 7/1997 | Zikeli et al. |
| 5,653,931 | A | 8/1997 | Eibl et al. |
| 5,698,151 | A | 12/1997 | Zikeli et al. |
| 5,827,463 | A | 10/1998 | Ruf |
| 5,863,478 | A | 1/1999 | Ruf et al. |
| 5,902,532 | A | 5/1999 | Pitowski |
| 5,951,933 | A | 9/1999 | Stall et al. |
| 5,993,710 | A | 11/1999 | Weigel et al. |
| 6,042,767 | A | 3/2000 | Hashemzadeh et al. |
| 6,103,162 | A | 8/2000 | Frigge et al. |
| 6,117,378 | A | 9/2000 | Eibl et al. |
| 6,153,136 | A | 11/2000 | Collier et al. |
| 6,159,601 | A | 12/2000 | Pitowski et al. |
| 6,241,927 | B1 | 6/2001 | Mulleder et al. |
| 6,241,933 | B1 | 6/2001 | Koll et al. |
| 6,245,837 | B1 | 6/2001 | Cassel et al. |
| 6,471,727 | B2 | 10/2002 | Luo et al. |
| 6,488,876 | B1 | 12/2002 | Ruf |
| 6,517,758 | B1 | 2/2003 | Gspaltl et al. |
| 6,527,987 | B1 | 3/2003 | Yabuki et al. |
| 6,773,648 | B2 | 8/2004 | Luo et al. |
| 6,902,690 | B1 | 6/2005 | Niemz et al. |
| 7,029,622 | B2 | 4/2006 | Likeli et al. |
| 7,364,681 | B2 | 4/2008 | Zikeli et al. |
| 2003/0116882 | A1 | 6/2003 | Kosan et al. |
| 2003/0155673 | A1 | 8/2003 | Zikeli et al. |
| 2003/0225206 | A1 | 12/2003 | Lee et al. |
| 2005/0189675 | A1 | 9/2005 | Redlinger et al. |
| 2005/0220916 | A1 | 10/2005 | Zikeli et al. |
| 2008/0054516 | A1 | 3/2008 | Kwon et al. |
| 2010/0256352 | A1 | 10/2010 | Uerdingen et al. |
| 2010/0289177 | A1 | 11/2010 | Redlinger et al. |
| 2015/0159302 | A1 | 6/2015 | Leitner et al. |

FOREIGN PATENT DOCUMENTS

| | | | |
|---|---|---|---|
| CN | 101285213 | A | 10/2008 |
| CN | 102477591 | A | 5/2012 |
| CN | 1449460 | A | 10/2013 |
| DE | 19600572 | A1 | 7/1997 |
| DE | 19753190 | A1 | 7/1999 |
| DE | 10203093 | A1 | 7/2003 |
| DE | 10304655 | A1 | 12/2003 |
| DE | 102011119840 | A1 | 6/2012 |
| EP | 0356419 | A2 | 2/1990 |
| EP | 0553070 | A1 | 7/1993 |
| EP | 0665904 | A1 | 8/1995 |
| EP | 0686712 | A2 | 12/1995 |
| EP | 0853146 | A2 | 7/1998 |
| EP | 0943027 | A1 | 9/1999 |
| EP | 1433881 | B2 | 6/2004 |
| EP | 1493850 | A1 | 1/2005 |
| EP | 1493753 | A1 | 5/2005 |
| EP | 1657258 | A1 | 5/2006 |
| EP | 1841905 | A1 | 10/2007 |
| EP | 2097563 | A1 | 9/2009 |
| EP | 2292815 | A1 | 3/2011 |
| GB | 2337990 | A | 12/1999 |
| JP | 2004159231 | A | 6/2004 |
| SU | 1224362 | A1 | 4/1986 |
| WO | 9214871 | A1 | 9/1992 |
| WO | 9319230 | A1 | 9/1993 |
| WO | 9409191 | A1 | 4/1994 |
| WO | 9419405 | A1 | 9/1994 |
| WO | 9428218 | A1 | 12/1994 |
| WO | 9501470 | A1 | 1/1995 |
| WO | 9502082 | A1 | 1/1995 |
| WO | 9504173 | A1 | 2/1995 |
| WO | 9516063 | A1 | 6/1995 |
| WO | 9607777 | A1 | 3/1996 |
| WO | 9607779 | A1 | 3/1996 |
| WO | 9617118 | A1 | 6/1996 |
| WO | 9620301 | A1 | 7/1996 |
| WO | 9621758 | A1 | 7/1996 |
| WO | 9723669 | A1 | 7/1997 |
| WO | 9725462 | A1 | 7/1997 |
| WO | 9733020 | A1 | 9/1997 |
| WO | 9735054 | A1 | 9/1997 |
| WO | 9736028 | A1 | 10/1997 |
| WO | 9736029 | A1 | 10/1997 |
| WO | 9738153 | A1 | 10/1997 |
| WO | 9746745 | A1 | 12/1997 |
| WO | 9802602 | A1 | 1/1998 |
| WO | 9806745 | A1 | 2/1998 |
| WO | 9809009 | A1 | 3/1998 |
| WO | 9822642 | A1 | 5/1998 |
| WO | 9830740 | A1 | 7/1998 |
| WO | 9858103 | A1 | 12/1998 |
| WO | 9919555 | A1 | 4/1999 |
| WO | 0168958 | A1 | 9/2001 |
| WO | 0181663 | A1 | 11/2001 |
| WO | 0190451 | A1 | 11/2001 |
| WO | 03014436 | A1 | 2/2003 |
| WO | 03057951 | A1 | 7/2003 |
| WO | 03057952 | A1 | 7/2003 |
| WO | 2005116309 | A1 | 12/2005 |
| WO | 2006000197 | A1 | 1/2006 |
| WO | 2008078961 | A1 | 7/2008 |
| WO | 2011048608 | A2 | 4/2011 |
| WO | 2014029748 | A1 | 2/2014 |

OTHER PUBLICATIONS

Fink, H.P. et al., "Structure formation of regenerated cellulose materials from NMMO-solutions", Prog. Polym. Sci., 26 (2001) pp. 1473-1524.

Simon, V., "Evaporative Cooling of Fibers by a Low-Reynolds-Number Crossflow", Transactions of the American Society of Mechanical Engineers (ASME), vol. 118, (Feb. 1996) pp. 246-249.

Chanzy, H. et al., "Spinning of cellulose from N-methylmorpholine N-oxide in the presence of additives" Polymer, vol. 31, (Mar. 1990) pp. 400-405.

Weigel P., et al., "The Structural Format of Cellulose Fibres from Amine Oxide Solutions",Lenzinger Berichte 94(9), (1994) pp. 31-36.

S.A. Mortimer & A.A. Peguy, "Methods for Reducing the Tendency of Lyocell Fibers to Fibrillate", Journal of Applied Polymer Science, vol. 60, (1996) pp. 305-316.

"Process for pretreating reclaimed cotton fibres to be used in the production of moulded bodies from regenerated cellulose", Research Disclosure, Jan. 2015, www.researchdisclosure.com, database No. 609040, published digitally Dec. 2014.

Helfried Stover, "Zur FasemasBcheuerung von Viskosefasern" Faserforschung and Textiltechnik, 19, Issue 10, (1968) pp. 447-452.

R. Holler, "New Method of Characterizing Fibers of Regenerated Cellulose", Melliand Textilberichte, 65, (1984) pp. 573-574.

English Translation of the International Preliminary Report on Patentability for International Application No. PCT/EP2014/079043 dated Jul. 5, 2016.

H. Schleicher, et al., "Comparison of the Different Ways of CS2-Free Manufacturing of Cellulosic Man-Made Fibres" Lenzinger Berichte, 74, 1994.

Roder, Thomas et al., "Man-Made Cellulose Fibres—a Comparsion Based on Morphology and Mechanical Properties", Lenzinger Berichte 91 (2013) pp. 7-12.

CELLULOSE FIBER

This Application is a 371 of PCT/EP2014/079043, filed Dec. 22, 2014.

BACKGROUND OF THE INVENTION

Field of the Invention

The present invention relates to a cellulosic fiber of the Lyocell type.

In consequence of the environmental problems associated with the known viscose process for the production of cellulosic fibers, intense efforts have been made in recent decades to provide alternative and more environmentally friendly methods. A particularly interesting possibility which thereby has arisen in recent years is to dissolve cellulose in an organic solvent without a derivative being formed and to extrude moulded bodies from said solution. Fibers spun from such solutions have received the generic name Lyocell from BISFA (The International Bureau for the Standardization of man-made fibers), wherein an organic solvent is understood to be a mixture of an organic chemical and water.

Furthermore, such fibers are also known by the term "solvent-spun fibers".

It has turned out that in particular a mixture of a tertiary amine oxide and water is perfectly suitable as an organic solvent for the production of Lyocell fibers and other moulded bodies, respectively. Thereby, N-methylmorpholine-N-oxide (NMMO) is predominantly used as the amine oxide. Other suitable amine oxides are disclosed in EP-A 553 070.

In EP 0 356 419 A, a technical implementation of the method of producing a solution of a pulp in an amine oxide is described. In doing so, a suspension of the crushed pulp is conveyed in an aqueous tertiary amine oxide in the form of a thin layer across a heating surface, water is evaporated and, thereby, a spinnable cellulose solution is produced.

A method of spinning cellulose solutions in amine oxides is known from U.S. Pat. No. 4,246,221. According to said method, filaments extruded from a spinneret are guided through an air gap, drawn therein and, subsequently, the cellulose is precipitated in an aqueous spinning bath. The method is known as a "dry/wet spinning process" or also as an "air-gap spinning process".

The entire method of producing fibers from solutions of cellulose in a tertiary amine oxide is referred to in the following as an "amine oxide process", with the abbreviation "NMMO" denoting hereinafter all tertiary amine oxides which are able to dissolve cellulose. Fibers produced according to the amine oxide process are characterized by a high fiber strength in the conditioned state as well as in the wet state, a high wet modulus and a high loop strength.

The conditions within the air gap such as temperature, humidity, cooling rate of the filaments as well as draft dynamics are of great significance for the properties of the resulting fibers (see, in this connection, the publication by Volker Simon in "Transactions of the American Society of Mechanical Engineers (ASME) 118 (1996) No. February, p. 246-249").

Technical embodiments of the spinning process have been described in numerous documents:

WO 93/19230 describes a method wherein the extruded filaments are cooled just beneath the nozzle by being blasted with air. WO 94/28218 describes a nozzle design and a blowing method. WO 95/01470 claims a laminar flow of the cooling gas stream described in WO 93/19230. WO 95/04173 describes a further technical implementation of blowing. In WO 96/17118, the moisture content of the blowing air is defined. In WO 01/68958, the blowing air stream is directed downwards toward the extruded filaments at an angle of from 0° to 45°. WO 03/014436 describes a blowing device comprising a suction of the blowing air. WO 03/057951 claims the shielding of part of the air gap from the blowing air. In WO 03/057952, a turbulent gas stream for cooling the filaments is described. WO 05/116309 likewise describes the shielding of part of the air gap from the blowing air.

The fibers/filaments obtained according to the air-gap spinning process differ in structural terms from known viscose fibers. While the crystalline orientation is approximately at the same high level both in viscose fibers and in Lyocell fibers (a largely parallel arrangement of the cellulose chains located in the structured areas of the fiber relative to the fiber axis), considerable differences exist in the amorphous orientation (a higher parallelism of the random portions in Lyocell fibers).

The particularities of the Lyocell fiber such as a high crystallinity, long and thin crystallites and a high amorphous orientation prevent an adequate bond of the crystallites transversely to the fiber axis. In the wet state, the swelling of the fibers additionally reduces the bonding forces transversely to the fiber axis and thus leads to the separation of fiber fragments under mechanical strain. This behavior is referred to as wet fibrillation and causes quality losses in the form of greying and hairiness in the final textile product.

Surveys of the state of research in this field are provided by the works of Josef Schurz, Jurgen Lenz: "Investigations on the structure of regenerated cellulose fibers" in Macromolecular Symposia, Volume 83, Issue 1, pages 273-289, May 1994, and Fink H-P, Weigel P, Purz H-J, Ganster J "Structure formation of regenerated cellulose materials from NMMO-solutions" Prog. Polym. Sci. 2001 (26) p. 1473-1524.

Previous efforts to improve the wet-fibrillation resistance of Lyocell fibers were aimed in two directions:

varying the manufacturing conditions, or introducing a step of chemical cross-linking during the production process However, it is hardly possible to evaluate the success of the measures of reducing fibrillation which have been described in each case. There is no standardized method of measuring the fibrillation behavior, and all the methods applied in the patent literature are proprietary.

The second procedure, chemical cross-linking, is associated with a number of drawbacks such as additional chemicals/costs of chemicals/waste water problems during the production of the fiber environmental pollution during the production of the cross-linking chemicals inadequate hydrolysis stability of cross-linking under the conditions of textile processing.

Examples of the procedure of chemical cross-linking are described in EP 0 53 977 A, EP 0 665 904 A and EP 0 943 027 A, respectively.

Numerous documents have been published with regard to the first procedure, varying the manufacturing conditions. However, the described methods have either brought about only a slight improvement in the fibrillation behavior, which has not been reflected in a lasting improvement of processability, or the methods have failed to be feasible on a large scale as a result of the costs/technical expenditures.

In SU 1,224,362, a dope is spun from a single pulp into a bath containing NMMO in amyl alcohol or isopropanol, respectively. WO 92/14871 claims a fiber with a reduced fibrillation, characterized in that the pH of the spinning bath and of subsequent washing baths is below 8.5. No details are given about the type of the pulp or the spinning conditions.

WO 94/19405 describes a method wherein a pulp mixture is used. However, no reference is made to the tendency toward fibrillation of the fibers which have been spun.

WO 95/02082 describes a combination of process parameters, illustrated in a mathematical expression, for the production of a fiber with a low tendency toward fibrillation. Said process parameters are the diameter of the spinning hole, the output of spinning mass, the titer of the filaments, the width of the air gap and the humidity in the air gap. The pulp used is not described in detail, the spinning temperature is only 115° C.

In WO 95/16063, the extruded filaments are contacted in the spinning bath or in the aftertreatment baths, respectively, with a surfactant in a dissolved form. The type of the pulp used is not specified, the spinning temperature is 115° C.

WO 96/07779 uses an organic solvent, preferably polyethylene glycol, as a spinning bath. No details are given about the pulp used or the textile-mechanical properties of the obtained fibers. 110° C. is indicated as the spinning temperature.

In WO 96/07777, the extruded filaments are contacted in the air gap with an aliphatic alcohol provided in a gaseous form. The type of the pulp used is not specified, the spinning temperature is 115° C.

WO 96/20301 describes a method wherein the moulded solution is guided consecutively through at least two precipitation media, with a slower coagulation of the cellulose occurring in the first precipitation medium as compared to the latter precipitation medium. In the examples, a higher alcohol is preferably used as the first precipitation medium. The pulp used is not indicated, the spinning temperature amounts to 115° C.

WO 96/21758 describes a method wherein the moulded solution is blasted in the air gap in an upper zone with air having a higher moisture content and in a lower zone with air having a lower moisture content. Single pulps of various degrees of polymerization are used as pulps, the spinning temperature amounts to 115° C.

EP 0 853 146 describes a two-stage method wherein the dwell time of the fibers in the first precipitation stage is adjusted such that merely the stickiness of the surface of the solution moulded into fibers is prevented and the fibers are coagulated without tension in a later precipitation stage. In the examples, the spinning temperature amounts to 109-112° C.

In WO 97/23669, spinning takes place into a spinning bath having a content of NMMO of more than 60%. A single pulp is used.

In WO 97/35054, a combination of parameters for obtaining a fiber low in fibrillation is described, namely the concentration of the dope, the draft in the air gap as well as the diameter of the nozzle hole. A single pulp is used, the spinning temperature ranges from 80 to 120° C.

In WO 97/38153, a combination of parameters for obtaining a fiber low in fibrillation is likewise described, namely the length of the air gap, the spinning rate, the dwell time in the air gap, the speed of the blowing air in the air gap, the moisture content of the blowing air as well as the product of the dwell time in the air gap times the moisture content of the blowing air. A single pulp is used as the pulp.

In WO 97/36028, the fibers are treated with a solution of 40-80% NMMO, optionally with an additive being added, upon leaving the precipitation bath.

In WO 97/36029, the fibers are treated with a solution of zinc chloride upon leaving the precipitation bath.

In WO 97/46745, the fibers are treated with a solution of NaOH upon leaving the precipitation bath.

In WO 98/02602, the fibers are treated with a solution of NaOH upon leaving the precipitation bath in a relaxed state.

In WO 98/06745, a pulp mixture is used which is obtained by mixing solutions of pulps of different degrees of polymerization. No details are given with regard to the spinning temperature.

In WO 98/09009, the addition of additives (polyalkylenes, polyethylene glycols, polyacrylates) to the spinning mass is described. A single pulp is used as the pulp.

In WO 98/22642, a pulp mixture having a low degree of polymerization is used. The spinning temperature amounts to 110-120° C.

Also in WO 98/30740, a pulp mixture is used, the spinning mass is spun according to a centrifugal spinning process. The spinning temperature amounts to 80-120° C.

In WO 98/58103, details about the molecular weight distribution of the pulp in a spinning mass from a pulp mixture are indicated, which lead to stable spinning. However, no reference is made to the fibrillation behavior of the obtained fibers/filaments.

In DE 19753190, the fibers are treated with a concentrated NMMO solution upon leaving the precipitation bath.

In GB 2337990, a co-solvent is used for dissolving the single pulp. The nascent solution is spun at 60-70° C.

In U.S. Pat. No. 6,471,727, a spinning mass from a single pulp with a high content of hemicellulose and lignin is processed according to a dry/wet or meltblown spinning process, respectively.

In WO 01/81663, a spinneret is described in which the spinning capillary is directly heated close to the outlet cross-section. Said measure is supposed to reduce the tendency toward fibrillation of Lyocell fibers, however, no test conditions are specified for this.

WO 01/90451 describes a spinning method characterized by a mathematical relationship including the heat flux density in the air gap and the ratio of length to diameter of the extrusion channel. Fibers spun according to the invention are proposed to display a lower tendency toward fibrillation, however, no further details are given in this connection.

In U.S. Pat. No. 6,773,648, a meltblown process for the production of a fibrillation-reduced fiber is made public. Due to their irregular titers, meltblown fibers are unsuitable for textile use.

In DE 10203093, a fiber with a low fibrillation is produced by spinning two dopes of different cellulose concentrations from a single pulp from a biocomponent nozzle. No example is given.

In DE 10304655, polyvinyl alcohol is added to the NMMO in order to improve the quality of the solution. The conditions for spinning the claimed less fibrillating fiber are not indicated.

The specific structure of the Lyocell fiber leads, on the one hand, to excellent textile-mechanical properties such as a high strength in both the dry and wet states as well as to a very good dimensional stability of the planar assemblies produced therefrom and, on the other hand, to little flexibility (high brittleness) of the fibers, which manifests itself in a decrease in the abrasion resistance in comparison to viscose fibers within the planar assembly.

The term flexibility (compliance) is defined, according to Hooke's Law, as the quotient from the elongation of the test body and the load causing the elongation. Increasing the flexibility of Lyocell fibers is the object of a number of publications:

A flexible Lyocell fiber is described in EP 0 686 712. The patent claims a fiber with a reduced NMR degree of order, obtained by adding nitrogenous substances such as urea, caprolactam or aminopropanol to the polymer solution or into the precipitation bath, respectively. However, a fiber with a very low wet strength is obtained; thus, the fiber differs distinctly from the fibers according to the invention as described below.

In WO 97/25462, a method for the production of a flexible and fibrillation-reduced fiber is described, wherein, after the precipitation bath, the moulded fiber is guided through a washing and aftertreatment bath containing an aliphatic alcohol, in addition, optionally, with an additive of sodium hydroxide. The properties of the obtained fibers are described only very insufficiently. In particular data about the dry and wet strengths are missing, which would allow classification in the "Höller chart", as described in further detail below.

It may be said, however, that, in the examples of the present application, the fiber shows considerable differences in a comparison of the fiber elongations indicated in said document with the corresponding data of the fibers according to the invention and that, due to the low values of elongation as indicated in said document, the flexibility of the fiber cannot be very high according to the above-mentioned definition of flexibility. The improvement in the fibrillation behavior as mentioned in the text of the document is not confirmed by any data whatsoever.

Documents EP 1 433 881, EP 1 493 753, EP 1 493 850, EP 1 841 905, EP 2 097 563 and EP 2 292 815 describe fibers and filaments, respectively, preferably for the application tyre cord, produced by adding polyvinyl alcohol to the NMMO/dope. The fibers/filaments are characterized by high strength, but little elongation. Accordingly, their flexibility can only be minor according to the above-mentioned definition.

Further publications which indicate that, by adding additives to the spinning mass, influence can be exerted on the fibrillation behavior and/or the flexibility of the fiber, are Chanzy H, Paillet m, Hagege R "Spinning of cellulose from N-methylmorpholine N-oxide in the presence of additives" Polymer 1990, 31, p 400-5

Weigel P, Gensrich J, Fink H-P "Strukturbildung Cellulosefasem aus Aminoxidlösungen" Lenzinger Berichte 1994; 74(9), p 31-6 and Mortimer S A, Peguy A A "Methods for reducing the tendency of lyocell fibers to fibrillate" J. appl. Polym. Sci. 1996, 60, p 305-16.

WO 2014/029748 (not pre-published) discloses the manufacture of solvent-spun cellulosic fibers, especially from solutions in ionic liquids. Further state of the art in this regard is known from DE 10 2011 119 840 A1, AT 506 268 A1, U.S. Pat. No. 6,153,136, CN 102477591A, WO 2006/000197, EP 1 657 258 A1, US 2010/0256352 A1, WO 2011/048608 A2, JP 2004/159231 A and CN 101285213 A.

The invention of viscose fibers (Cross and Bevan 1892, GB 8700) occurred more than a hundred years ago. Despite weaknesses in the production (environmental problems) and the properties (poor washing behavior of the standard type), more than one million tons of said fiber type is produced each year.

The further development of the old process after the second world war (polynosic and modal fibers) resulted in fibers with a better washing behavior and a higher dimensional stability, but was unable to change the intrinsic properties of the method (environmental relevance as well as, due to the large number of process steps, an extremely complicated method).

Conversely, it became apparent during the development of the new fiber type "Lyocell" that, due to its varying structure, the fiber places special demands on the processing conditions and, thus, the established methods of processing a viscose or modal fiber cannot be applied in the textile chain. Special machines and processing adjustments which are adapted to the fiber are required especially for dyeing and wet finishing. Today, more than 20 years after the Lyocell fiber was placed on the market, this is still regarded as a disadvantage.

Now it would be desirable to impart particular properties of the viscose fiber such as a lower tendency toward fibrillation in the wet state higher flexibility (less brittleness)

to the Lyocell fiber while maintaining the excellent properties of the Lyocell fiber (such as, e.g., a high wet strength, a high wet modulus and, hence, a washability and a dimensional stability which, in comparison to viscose fibers, are substantially improved).

It is thus an object of the present invention to provide a Lyocell fiber with properties more similar to viscose by means of which processing of the fiber according to the well-known and established methods of viscose processing is rendered possible.

The change in properties should be achieved solely by choosing suitable process parameters for the production of the fiber, without having to fall back on chemicals extraneous to the process as additives to either the spinning mass, the spinning bath or during the aftertreatment. Every additional chemical in the system, be it as an additive to the spinning mass or to the spinning bath, necessitates increased efforts for the recovery and constitutes a cost factor.

The object of the present invention is achieved by a cellulosic fiber of the Lyocell type which has a titer of from 0.8 dtex to 3.3 dtex and is characterized by the following relationships:

Höller factor F2≥1, preferably ≥2

Höller factor F1≥−0.6

Höller factor F2≤6 and

Höller factor F2 minus 4.5*Höller factor F1≥1, preferably ≥3.

SHORT DESCRIPTION OF THE FIGURES

DETAILED DESCRIPTION OF THE INVENTION

In the following, the new Lyocell fibers according to the invention are described by reference to the so-called "Höller factors" F1 and F2 and are distinguished from known cellulosic man-made fibers of the prior art.

While the basic chemical structure of man-made cellulosic fibers such as, e.g., viscose fibers, but also of Lyocell fibers, is essentially the same (cellulose), the fibers differ in factors such as, e.g., the crystallinity or also the orientation in particular of amorphous areas. It is difficult to quantitatively distinguish those factors from each other.

It is also apparent to a person skilled in the art that a Lyocell fiber differs, for example, from a viscose fiber in textile-mechanical parameters (such as, e.g., strength values), but also in properties which can be defined less clearly, e.g., the textile "grip". Likewise, there are considerable differences between the different types of cellulose fibers produced according to the viscose process such as, e.g., a (standard) viscose fiber, a modal fiber or a polynosic fiber.

In the essay by R. Höller "Neue Methode zur Charakterisierung von Fasem aus Regeneratcellulose" Melliand Textilberichte 1984 (65) p. 573-4, a clear differentiation between the different fiber types made of regenerated cellulose known at the time, i.e., the fibers produced according to the viscose process, could be presented on the basis of quantitative features.

According to this suggestion the complexity of the comparison of a greater number of fiber properties could be simplified significantly by way of formation of few parameters splitting fibers into groups of similar properties and by factor analysis. Factor analysis is a multivariate statistical method which makes it possible to reduce a group of correlated features to a smaller number of uncorrelated factors.

The textile-mechanical properties used by Höller for factor analysis were the maximum tensile force conditioned (FFk) and wet (FFn), the maximum tensile force elongation conditioned (FDk) and wet (FDn), the wet modulus (NM), the loop strength conditioned (SFk) as well as the knot strength conditioned (KFk).

All those measurands as well as their determination are known to a person skilled in the art, see, in particular, BISFA regulation "Testing methods viscose, modal, lyocell and acetate staple fibers and tows" Edition 2004 Chapters 6 and 7, and will be described in further detail below.

Figure 1:
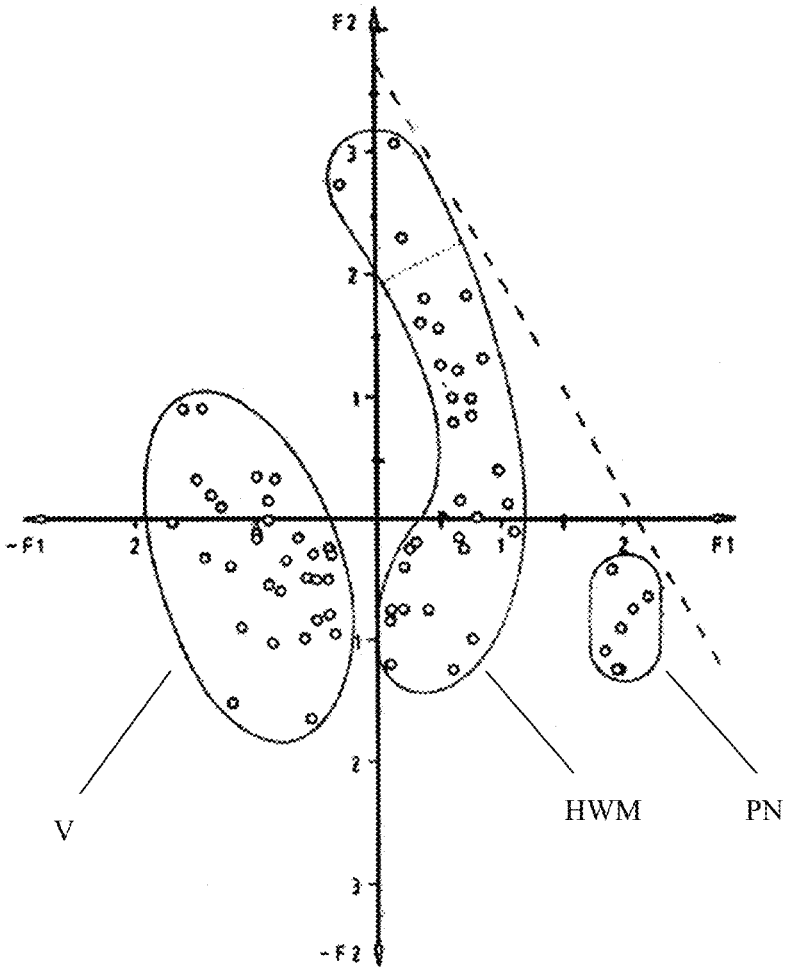
FIG. 1 shows a Höller chart of commercially available fibers from regenerated cellulose prior to the development of the Lyocell fiber.

In the fiber collective available to Höller, 87% to 92% of the variance between the samples could be detected by merely two factors (see FIG. 1). Those two factors are calculated as follows:

$$\text{Höller factor } F1=-1.109+0.03992\times FFk-0.06502\times FDk+0.04634\times FFn-0.04048\times FDn+0.08936\times NM+0.02748\times SFk+0.02559\times KFk$$

$$\text{Höller factor } F2=-7.070+0.02771\times FFk+0.04335\times FDk+0.02541FFn+0.03885FDn-0.01542\times NM+0.2891\times SFk+0.1640\times KFk.$$

As can be seen in FIG. 1, a clear differentiation between the different fiber types could be illustrated by way of this analysis—drawn up on the basis of clearly measurable parameters.

FIG. 1 shows in the coordinate system of Höller factors F1 and F2 the fiber collective made up of 70 samples of commercially available fibers of regenerated cellulose which has been examined by Höller. Along factor F1, it is possible to identify the division into (standard) viscose fibers and modal fibers, which are also listed by BISFA as different fiber types (although they are produced according to the same basic method, namely the viscose process). To the left of the ordinate, the region of (standard) viscose fibers is shown (designated as "V" in FIG. 1). Essentially to the right of the ordinate the region of modal fibers is shown, which are further structured in two sub-groups, i.e. fibers of the HWM-type ("HWM"—high wet modulus) and fibers of the polynosic type ("PN"). In addition, a (dashed) boundary is plotted in the graph, beyond which none of the fibers made of regenerated cellulose and examined at the time were located. However, at the time of this publication, Lyocell fibers were still in the trial stage and not commercially available.

Lyocell fibers which currently are commercially available have Höller F1 values of 2 to 3 and F2 values of 2 to 8. In the "Höller chart" according to FIG. 1, such fibers would therefore be located beyond the above-mentioned boundary, from which the considerable difference between the fibers of the viscose group and the Lyocell fibers is apparent already purely visually.

The fiber according to the invention is now located in an area of the Höller chart which can be illustrated by a square.

The sides of the square correspond to the following values or relationships, respectively:

Lower boundary F2=1

Left-hand boundary F1=−0.6

Upper boundary F2=6

Right-hand boundary defined via the relationship:

Höller factor F2 minus 4.5*Höller factor F1≥1, preferably ≥3

Figure 2:
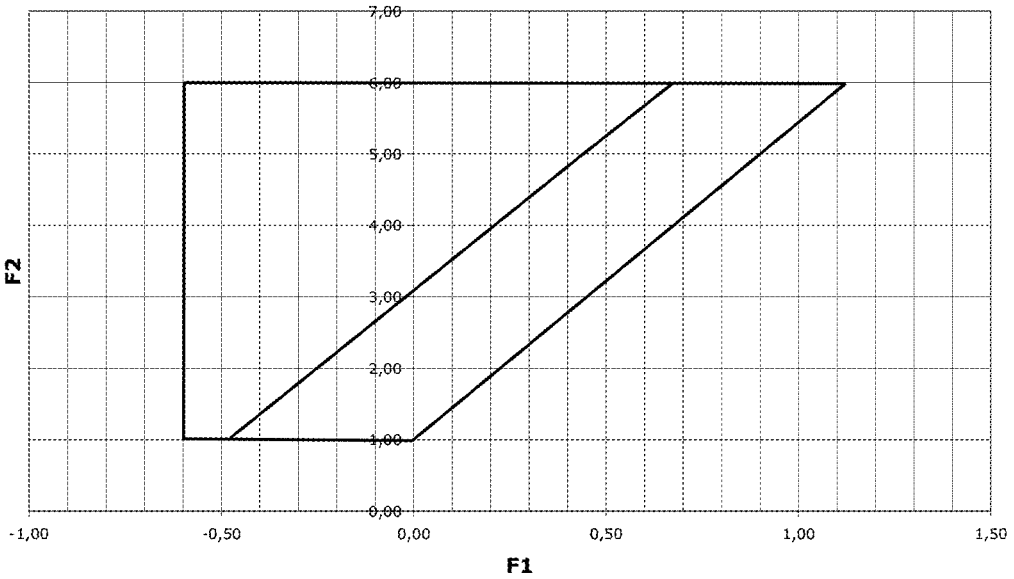
FIG. 2 shows the area in the Höller chart in which the fibers according to the invention are located.

The arrangement of the Lyocell fiber according to the invention in the Höller chart resulting from said relation is shown in FIG. 2. Loosely speaking, the fiber according to the invention thus occupies in the Höller chart the space above the abscissa and around the ordinate as well as to the left thereof and is clearly distinguished from Lyocell fibers which are currently commercially available and, in the Höller chart, are located, loosely speaking, (considerably) to the right of the ordinate.

Conversely, the Lyocell fiber according to the invention is located in the Höller chart close to the area of the (standard) viscose. Actually, it has been shown that the Lyocell fiber according to the invention has, with regard to its processability, properties which are by far "more similar to viscose" than those of Lyocell fibers which are currently commercially common.

In textile practice, these "more viscose-like" properties lead to the following property changes:

The fiber according to the invention can be dyed as a planar assembly like viscose in a strand (conventional Lyocell fibers are only suitable for open-width dyeing).

Planar assemblies (such as knitted fabrics) made of the fiber according to the invention, which have not been subjected to high-grade finishing with a resin finish, will keep an unchanged fabric appearance for a longer time when being washed.

Planar assemblies made of the fiber according to the invention exhibit an abrasion resistance similar to planar assemblies made of viscose and hence display an improvement by the double in comparison to conventional Lyocell fibers.

However, the fiber according to the invention retains during washing processes the high dimensional stability which is characteristic of the Lyocell fiber.

Although the areas of the fiber according to the invention and of (standard) viscose fibers as well as, partially, of modal fibers overlap in the Höller chart, the fiber types can, however, clearly be differentiated from each other based on basic differences in the manufacturing process, since the fiber according to the invention can be analytically distinguished unambiguously from fibers produced according to the viscose process such as (standard) viscose fibers and modal fibers:

A residual amount of solvent associated to the fiber type Lyocell is detectable (in particular residues of NMMO in case of fibers produced according to the amine oxide process).

Unlike a fiber produced according to the viscose process, the fiber contains no sulphur.

According to the method described below, the wet abrasion behavior of the fiber according to the invention ranges between 300 and 5000 revolutions up to the point of fiber breakage, preferably between 500 and 3000 revolutions.

The flexibility (i.e., the quotient FDk/FFk) of the fiber according to the invention preferably ranges between 0.55 and 1.00, preferably between 0.65 and 1.00.

It has been shown that the dry abrasion according to Martindale of a single jersey 150 g/m$^2$ made of a ring yarn Nm 50/1 of the fiber according to the invention may range between 30 000 and 60 000 tours up to the point of hole formation.

The fiber according to the invention is preferably characterized in that it is produced according to the amine oxide process.

The fiber according to the invention is preferably provided as a staple fiber, i.e., as cut fibers.

The property change according to the invention of Lyocell fibers toward a Lyocell fiber similar to viscose and hence the repositioning of the fiber data in the Höller chart is achieved, according to the present invention, by carefully adjusting the raw material and the process conditions:

1) Pulp

A defined molecular weight distribution of the raw material used is required for the production of the fiber according to the invention. This is achieved in particular by mixing two or more single pulps. Accordingly, the fiber according to the invention is preferably characterized in that it is produced from a mixture of at least two different pulps.

The molecular weight distribution is characterized by the following parameters:

a) The amount of celluloses or accompanying substances of cellulose (polymeric pentosans and hexosans such as xylan, glucomannan, low-molecular beta-1,4-glucan) with a degree of polymerization of less than 50 is below 2% (based on the pulp mixture), preferably below 1.5% (determination of the molecular weight distribution with GPC/SEC by MALLS detection in DMAC/LiCl, Bohm, R., A. Potthast, et al. (2004). "A novel diazo reagent for fluorescence labeling of carboxyl groups in pulp." Lenzinger Berichte 83: 84-91).

b) An amount of 70% to 95% of the pulp mixture has a limiting viscosity number ranging from 250 to 500 ml/g, preferably from 390 to 420 ml/g (measured according to SCAN-CM 15:99), in the following referred to as the "low-molecular component".

c) An amount of 5% to 30% of the pulp mixture has a limiting viscosity number of from 1000 to 2500 ml/g, preferably of 1500-2100 ml/g, in the following referred to as the "high-molecular component".

d) Preferably, the amount of the low-molecular component is 70-75%, if the high-molecular component has a limiting viscosity number of 1000-1800 ml/g, and, respectively, 70-95%, if the high-molecular component has a limiting viscosity number of >2000 ml/g.

e) Furthermore, the purity of the pulps used is important: The purity is defined as the mean value of alkali resistances R10 and R18 according to DIN 54355 (1977), i.e. the determination of the resistance of pulp against caustic soda (alkali resistance). Said value approximately corresponds to the content of alpha cellulose according to TAPPI T 203 CM-99.

The purity of the low-molecular component is >91%, preferably >94%, the purity of the high-molecular component is >91%, preferably >96%.

It has been shown that, in particular by using high-purity pulps such as cotton linter pulps, it is possible more easily to produce fibers displaying the properties according to the invention.

Furthermore, it has been shown that pulps made from reclaimed cotton textiles ("reclaimed cotton fibers"—RCF) are suitable for the manufacture of the fibers according to the invention. Such pulps can be produced according to the teaching of the publication "Process for pretreating reclaimed cotton fibers to be used in the production of moulded bodies from regenerated cellulose" (Research Disclosure, www.researchdisclosure.com, database number 609040, published digitally Dec. 11, 2014).

2) Spinning Conditions

In addition to choosing the appropriate pulp composition, the spinning conditions for producing the fiber according to the invention are of particular importance:

i) The throughput of spinning mass should range between 0.01 and 0.05 g/nozzle hole/min, preferably between 0.015 and 0.025 g/nozzle hole/min.

ii) Air gap length: The procedure of producing the fiber according to the invention differs from the prior art (WO 95/02082, WO 97/38153) in that the air gap length does not constitute a relevant parameter. Fibers according to the invention are obtained already with an air gap length starting from 20 mm.

iii) Climate within the air gap: The production of the fiber according to the invention also differs from the prior art (WO 95/02082, WO 97/38153) in that the humidity and the temperature of the blowing air do not constitute relevant parameters. Humidity values of the blowing air of between 0 g/kg air and 30 g/kg air are applicable, and the temperature of the blowing air may range between 10° C. and 30° C. (it is known to a person skilled in the art that, for a given humidity setpoint of the blowing air, a minimum air temperature corresponding to a relative humidity of 100% cannot be fallen short of).

The speed of the blowing air in the air gap is lower than for the production of Lyocell fibers which currently are commercially available and should be below 3 m/sec, preferably at about 1-2 m/sec.

iv) Draft in the air gap: The value of the draft in the air gap (quotient of the haul-off speed from the spinning bath to the extrusion speed from the nozzle) should be below 7. Given a defined titer of the fiber, a small draft is achievable by using nozzles with small hole diameters. Nozzles having a hole diameter of ≤100 μm are usable, nozzles having a hole diameter of between 40 μm and 60 μm are preferred.

v) Spinning temperature: Spinning must occur at a temperature as high as possible, which is limited only by the thermostability of the solvent. However, it must not fall short of a value of 130° C.

vi) The spinning bath temperature may range between 0° C. and 40° C., values of from 0° C. to 10° C. are preferred.

vii) During the transport of the fiber from the spinning bath into the aftertreatment and during the aftertreatment, the filaments should be exposed, according to WO 97/33020, to a tensile load in the longitudinal direction of not more than 5.5 cN/tex.

It has been shown that, if the above parameters are met, Lyocell fibers which comply with the relations according to the invention with regard to the two Höller factors F1 and F2 and thus have more "viscose-like" properties are obtained in a reproducible way.

The present invention also relates to a fiber bundle comprising a plurality of fibers according to the invention. A "fiber bundle" is understood to be a plurality of fibers, for example, a plurality of staple fibers, a strand of continuous filaments or a bale of fibers.

Measuring Methods:

Testing of Textile-Mechanical Properties:

The determination of the titer of the fibers (linear density) was carried out according to BISFA regulation "Testing methods viscose, modal, lyocell and acetate staple fibers and tows" Edition 2004 Chapter 6 by means of a vibroscope, type Lenzing Technik.

The determination of the maximum tensile force (breaking tenacity), of the maximum tensile force elongation (elongation at break) in the conditioned and wet state, and of the wet modulus was carried out, according to the above-mentioned BISFA regulation, Chapter 7, by means of a tensile testing device Lenzing Vibrodyn (device for tensile tests on single fibers at a constant deformation speed).

The loop strength was determined on the basis of DIN 53843, Part 2, in the following way:

The titers of the two fibers used for the test are determined on the vibroscope. For determining the loop strength, the first fiber is formed into a loop and clamped with both ends into the pre-load weight (size of the pre-load weight according to the above-mentioned BISFA regulation, Chapter 7). The second fiber is drawn into the loop of the first fiber and the ends are placed into the upper clamp (measuring head) of the tensile testing device in such a way that the interlacing is located in the middle of the two clamps. After the pre-load has levelled out, the lower clamp is closed and the tensile test is started (clamping length 20 mm, traction speed 2 mm/min). It should be made sure that the breakage of the fiber occurs at the loop arc. As a titer-related loop strength, the measured maximum tensile force value, which has been obtained, is divided by the smaller one of the two fiber titers.

The knot strength was determined on the basis of DIN 53842, Part 1, in the following way:

A loop is formed from the fiber to be tested, one end of the fiber is drawn through the loop and, thus, a loose knot is formed. The fiber is placed into the upper clamp of the tensile testing device in such a way that the knot is located in the middle between the clamps. After the pre-load has levelled out, the lower clamp is closed and the tensile test is started (clamping length 20 mm, traction speed 2 mm/min). For the evaluation, only results are used in which the fiber has actually broken at the knot.

Determination of the Fibrillation Behavior According to the Wet Abrasion Method:

The method described in the publication by Helfried Stöver: "Zur Fasernassscheuerung von Viskosefasern" Faserforschung and Textiltechnik 19 (1968) Issue 10, p. 447-452, was employed.

The principle is based on the abrasion of single fibers in the wet state using a rotating steel shaft coated with a viscose filament hose. The hose is continuously moistened with water. The number of revolutions until the fiber has been worn through and the pre-load weight triggers a contact is determined and related to the respective fiber titer.

Device: Abrasion Machine Delta 100 of Lenzing Technik Instruments Departing from the above-cited publication, the steel shaft is continuously shifted in the longitudinal direction during the measurement in order to prevent the formation of grooves in the filament hose.

Source of supply of the filament hose: Vom Baur GmbH & KG. Marktstraβe 34, D-42369 Wuppertal Test Conditions:

Water flow rate: 8.2 ml/min

Speed of rotation: 500 U/min

Abrasion angle: 40° for titer 1.3 dtex, 50° for titer 1.7 dtex, 50° for titer 3.3 dtex Pre-load weight: 50 mg for titer 1.3 dtex, 70 mg for titer 1.7 dtex, 150 mg for titer 3.3 dtex Determination of the Abrasion Resistance of Planar Assemblies According to Martindale:

Methods according to the standard „Determination of the Abrasion Resistance of Planar Textile Assemblies by means of the Martindale Method-Part 2: Definition of the Destruction of Samples (ISO 12947-2:1998+Cor.1:2002; German version EN ISO 12947-2:1998+AC:2006).

EXAMPLES

The pulps and pulp mixtures, respectively, described below in Table 1 were processed into spinning masses of the composition indicated in Table 2 and spun into fibers having a titer of approx. 1.2 to approx. 1.6 dtex by a spinning method according to WO 93/19230 under the conditions of Table 2.

Constant parameters not indicated in the table are:

the spinning mass output of 0.02 g/hole/min the air gap of 20 mm the humidity of the blowing air of 8-12 g $H_2O$/kg air the temperature of the blowing air of 28-32° C.

the speed of the blowing air in the air gap of 2 msec

The textile-mechanical data of the obtained fibers are indicated in Table 3. The Höller factors calculated from the textile data, the wet abrasion value and the flexibility of the fibers can be seen in Table 4. The results clearly show the impact of the pulp and the particular importance of the spinning temperature.

TABLE 1

| Pulp | code | limiting viscosity number ml/g | alpha content % | amount of DP <50 % | DP >2000 |
|---|---|---|---|---|---|
| Solucell 250 | So 250 | 270 | 91.8 | 1.3 | 2.8 |
| Borregard Derivative HV | Bo HV | 1030 | n.b. | 1.4 | 49.1 |
| Saiccor | Sai | 383 | 90.4 | 6.6 | 14.9 |
| Borregard Derivative VHV | Bo VHV | 1500 | 92.7 | n.b. | n.b. |
| Solucell 400 | So 400 | 415 | 94.9 | 1.9 | 11.8 |
| Cotton Linters low MW | Co LV | 396 | 97.1 | 0.6 | 0 |
| Cotton Linters high MW | Co HV | 2030 | 99.1 | 0 | 98.3 |
| Reclaimed cotton fibers, | RCF LV | 423 | 97.1 | 0.45 | 7.7 |

TABLE 1-continued

| Pulp | code | limiting viscosity number ml/g | alpha content % | amount of DP <50 % | DP >2000 |
|---|---|---|---|---|---|
| low MW Reclaimed cotton fibers, high MW | RCF HV | 1840 | 97.8 | 0 | 68.7 |

The pulps "RCV LV" and "RCV HV" were produced according to the teaching of the publication "Process for pretreating reclaimed cotton fibers to be used in the production of moulded bodies from regenerated cellulose" (Research Disclosure, www.researchdisclosure.com, database number 609040, published digitally Dec. 11, 2014).

TABLE 2

| | pulp or pulp mixture, respectively | ratio high-molecular amount/low-molecular amount | cellulose in spinning mass % | water in spinning mass % | nozzle μ | draft | spinning temperature ° C. | spinning bath temperature ° C. |
|---|---|---|---|---|---|---|---|---|
| Example 1 | Co HV/Co LV | 10/90 | 11 | 12 | 40 | 1.54 | 131 | 0 |
| Example 2 | Co HV/Co LV | 10/90 | 11 | 12 | 50 | 2.41 | 131 | 0 |
| Example 3 | Co HV/Co LV | 10/90 | 11 | 12 | 60 | 3.47 | 130 | 0 |
| Example 4 | Co HV/Co LV | 10/90 | 11 | 12 | 80 | 6.17 | 130 | 0 |
| Example 5 | Co HV/Co LV | 10/90 | 11 | 12 | 60 | 3.47 | 130 | 20 |
| Example 6 | Co HV/Co LV | 10/90 | 11 | 10.5 | 50 | 2.41 | 132 | 0 |
| Example 7 | Co HV/Co LV | 10/90 | 11 | 10.5 | 50 | 2.41 | 132 | 20 |
| Example 8 | Co HV/Co LV | 10/90 | 13 | 11.7 | 50 | 2.85 | 131 | 0 |
| Example 9 | Co HV/Co LV | 5/95 | 13.5 | 10 | 50 | 2.96 | 130 | 20 |
| Example 10 | Co HV/Co LV | 5/95 | 13.5 | 10 | 50 | 2.96 | 131 | 0 |
| Example 11 | Bo HV/So 250 | 30/70 | 11 | 12 | 40 | 1.54 | 130 | 20 |
| Example 12 | Bo HV/So 250 | 30/70 | 11 | 12 | 50 | 2.41 | 130 | 20 |
| Example 13 | Bo HV/So 250 | 30/70 | 11 | 12 | 60 | 3.47 | 130 | 20 |
| Example 14 | Bo HV/So 250 | 30/70 | 11 | 12 | 70 | 4.73 | 130 | 20 |
| Example 15 | Bo VHV/So 400 | 24/76 | 11 | 12 | 50 | 2.41 | 132 | 20 |
| Example 16 | RCF HV/ RCF LV | 10/90 | 11 | 12 | 50 | 2.41 | 130 | 0 |
| Example 17 | Bo VHV/ RCF LV | 10/90 | 11 | 12 | 50 | 2.41 | 132 | 0 |
| Comparative Example 1 | Co HV/Co LV | 5/95 | 13.5 | 10 | 50 | 2.96 | 122 | 0 |
| Comparative Example 2 | Co HV/Co LV | 10/90 | 11 | 12 | 100 | 9.64 | 130 | 20 |
| Comparative Example 3 | Sai | | 12.8 | 10.5 | 40 | 1.80 | 132 | 20 |
| Comparative Example 4 (commercial Lyocell fiber) | Sai | | 13 | 10.5 | 100 | 11.4 | 124 | 20 |

TABLE 3

| | titer dtex | FFk cN/tex | FDk % | FFn cN/tex | FDn % | NM cN/tex, 5% | SFk cN/tex | KFk cN/tex |
|---|---|---|---|---|---|---|---|---|
| Example 1 | 1.37 | 21.8 | 15.2 | 16.7 | 22.8 | 4.2 | 14.8 | 21.3 |
| Example 2 | 1.37 | 25.1 | 21.5 | 17.8 | 28.2 | 3.9 | 15.7 | 23.3 |
| Example 3 | 1.37 | 26.4 | 17.4 | 19.0 | 22.2 | 4.8 | 16.3 | 23.3 |
| Example 4 | 1.37 | 26.3 | 16.5 | 20.8 | 22.8 | 5.4 | 17.5 | 25.1 |
| Example 5 | 1.36 | 26.0 | 14.0 | 17.5 | 20.5 | 4.7 | 14.5 | 22.7 |
| Example 6 | 1.23 | 24.5 | 19.0 | 18.7 | 25.5 | 4.4 | 16.1 | 22.5 |
| Example 7 | 1.34 | 24.7 | 17.5 | 20.0 | 24.4 | 5.5 | 16.7 | 24.1 |
| Example 8 | 1.54 | 26.4 | 16.1 | 19.5 | 21.7 | 4.7 | 17.4 | 23.6 |
| Example 9 | 1.29 | 27.5 | 14.9 | 20.5 | 21.0 | 5.8 | 20.6 | 24.9 |
| Example 10 | 1.37 | 24.8 | 17.8 | 19.4 | 24.2 | 4.5 | 19.1 | 23.6 |
| Example 11 | 1.34 | 21.3 | 14.1 | 14.9 | 22.8 | 3.6 | 11.5 | 19.2 |
| Example 12 | 1.30 | 24.1 | 15.2 | 15.4 | 19.2 | 4.4 | 10.2 | 19.4 |

TABLE 3-continued

| | titer dtex | FFk cN/tex | FDk % | FFn cN/tex | FDn % | NM cN/tex, 5% | SFk cN/tex | KFk cN/tex |
|---|---|---|---|---|---|---|---|---|
| Example 13 | 1.37 | 22.9 | 15.9 | 18.1 | 22.7 | 4.4 | 11.1 | 20.3 |
| Example 14 | 1.30 | 25.3 | 14.6 | 19.4 | 21.8 | 5.0 | 12.0 | 20.5 |
| Example 15 | 1.30 | 27.5 | 16.9 | 22.7 | 22.8 | 6.0 | 13.2 | 23.8 |
| Example 16 | 1.36 | 24.6 | 16.0 | 18.5 | 23.9 | 4.2 | 14.8 | 22.4 |
| Example 17 | 1.32 | 23.1 | 16.5 | 17.9 | 24.5 | 4.0 | 14.1 | 20.9 |
| Comparative Example 1 | 1.30 | 28.8 | 15.0 | 21.1 | 23.6 | 5.3 | 20.9 | 25.2 |
| Comparative Example 2 | 1.43 | 27.7 | 11.1 | 21.6 | 16.1 | 8.1 | 16.7 | 25.0 |
| Comparative Example 3 | 1.31 | 30.1 | 13.5 | 22.3 | 16.4 | 6.9 | 11.3 | 21.1 |
| Comparative Example 4 commercial Lyocell fiber | 1.37 | 39.3 | 13.6 | 34.9 | 18.6 | 10.6 | 18.9 | 31.7 |

TABLE 4

| | Höller factor F1 | Höller factor F2 | wet abrasion value revolutions until breakage | flexibility FDk/FFk |
|---|---|---|---|---|
| Example 1 | −0.05 | 3.20 | 1951 | 0.70 |
| Example 2 | −0.45 | 4.39 | 1947 | 0.86 |
| Example 3 | 0.27 | 4.22 | 664 | 0.66 |
| Example 4 | 0.51 | 4.88 | 370 | 0.63 |
| Example 5 | 0.40 | 3.33 | 244 | 0.54 |
| Example 6 | −0.12 | 4.16 | 1427 | 0.78 |
| Example 7 | −0.07 | 5.02 | 1455 | 0.71 |
| Example 8 | 0.42 | 4.53 | 511 | 0.61 |
| Example 9 | 0.84 | 5.61 | 303 | 0.54 |
| Example 10 | 0.17 | 5.15 | 635 | 0.72 |
| Example 11 | −0.28 | 1.82 | 336 | 0.66 |
| Example 12 | −0.04 | 1.45 | 585 | 0.63 |
| Example 13 | −0.09 | 2.06 | 410 | 0.70 |
| Example 14 | 0.27 | 2.36 | 312 | 0.58 |
| Example 15 | 0.52 | 3.49 | 443 | 0.62 |
| Example 16 | 0.08 | 3.59 | 1153 | 0.65 |
| Example 17 | −0.14 | 3.13 | 821 | 0.71 |
| Comparative Example 1 | 1.21 | 5.94 | 332 | 0.52 |
| Comparative Example 2 | 1.45 | 4.16 | 125 | 0.40 |
| Comparative Example 3 | 1.05 | 2.17 | 30 | 0.45 |
| Comparative Example 4 commercial Lyocell fiber | 2.72 | 6.17 | 40 | 0.34 |

Figure 3:
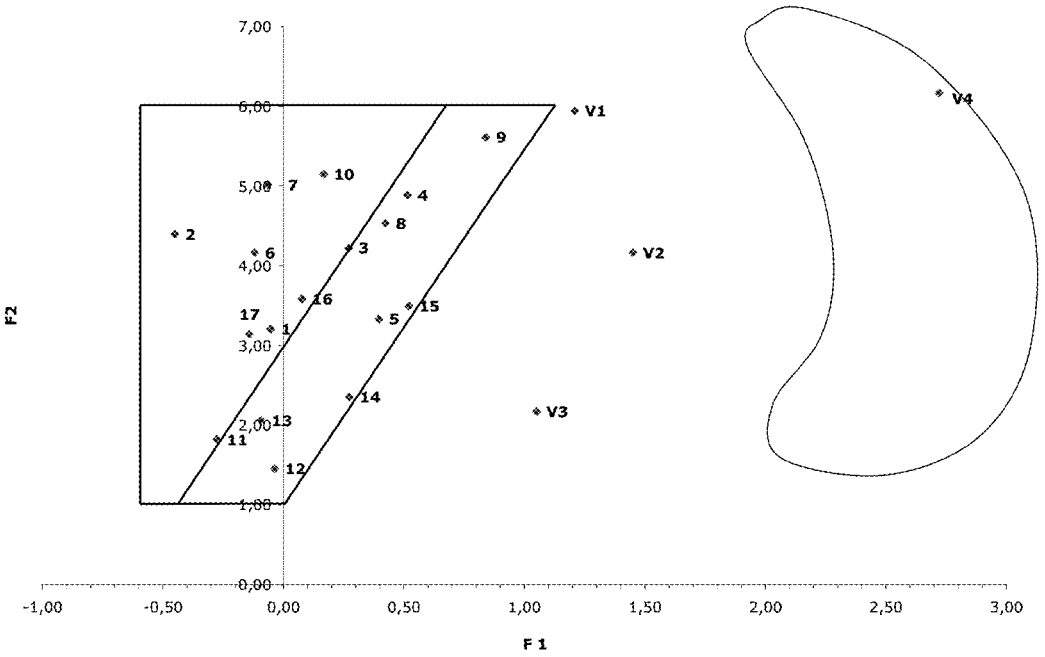
FIG. 3 shows a Höller chart in which the fiber according to the invention is contrasted to a common Lyocell fiber.

FIG. 3 shows the position of the examples/comparative examples in the Höller chart as well as the area of the chart which is claimed according to the invention. Therein, examples 1 to 17 (according to the invention) are designated with their respective numbers, while the comparative examples 1 to 4 are designated with a pre-fix "V", respectively.

Comparative Example 1 demonstrates that the object according to the invention is not achieved if the spinning temperature, which, at 122° C., is below the required value of at least 130° C. even if all remaining manufacturing parameters correspond to the parameters for the production of the fiber according to the invention.

Comparative Example 2 demonstrates that the object according to the invention is not achieved if the draft, which, at 9.64, is above the required value of less than 8.00, even if all remaining manufacturing parameters correspond to the parameters for the production of the fiber according to the invention.

Comparative Example 3 demonstrates the significance of the pulp. The object according to the invention is not achieved if the pulp composition, which, with a single pulp, fails to exhibit the necessary proportion of a very high and a low molecular weight, even if all remaining manufacturing parameters correspond to the parameters for the production of the fiber according to the invention.

Comparative Example 4 shows the properties and the position in the Höller chart of a commercial Lyocell fiber (Tencel® of Lenzing AG).

Processing Example:

A 130 kg bale of a fiber of 1.3 dtex/38 mm according to Example 11 was processed into a ring yarn Nm 50. A single jersey with a mass per unit area of 150 g/m2 was produced from said yarn. A sample of this single jersey was dyed with 4% Novacronmarine FG, bath ratio 1:30, at 60° C. in a laboratory jet for 45 min and subsequently subjected to 15 household washings at 60° C.

Table 5 shows the abrasion and washing behavior of this single jersey in comparison to a planar assembly of the same structure made of a commercial viscose or Lyocell fiber, respectively.

TABLE 5

| | Fiber according to Example 11 | viscose 1.3 dtex | Lyocell standard 1.3 dtex |
|---|---|---|---|
| Abrasion Martindale tours until hole formation | 57 500 | 58 750 | 15 500 |
| Washing test | | | |
| Grey scale* | | | |
| Grade after 1st washing | 4-5 | 4 | 3-4 |
| Grade after 5th washing | 4-5 | 4 | 1 |
| Grade after 10th washing | 3 | 4-5 | 2 |
| Grade after 15th washing | 2-3 | 4-5 | 1 |

*Grades from 1 to 5, the best grade is 5

The invention claimed is:

1. A cellulosic fiber of the lyocell type which has a titre of from 0.8 dtex to 3.3 dtex and having the following relationships:

Höller factor F2≥1,

Höller factor F1≥−0.6

Höller factor F2≤6 and

Höller factor F2 minus 4.5*Höller factor F1≥1 wherein Höller factor F1 is −1.109+0.03992*FFk (maximum tensile force conditioned (cN/tex))−0.06502*FDk(maximum tensile force elongation conditioned (%))+0.04634*FFn(maximum tensile force wet (cN/tex))−0.04048*FDn(maximum tensile force elongation wet (%))+0.08936*NM(wet modulus (cN/tex, 5%))+0.02748*SFk(loop strength conditioned (cN/tex))+0.02559*KFk(knot strength conditioned cN/tex); and wherein Höller factor F2 is −7.070+0.02771*FFk+0.04335*FDk+0.02541*FFn+0.03885*FDn−0.01542*NM+0.2891*SFk+0.1640*KFk.

2. The fiber according to claim 1, wherein a single jersey 150 g/m2 produced from a ring yarn Nm 50/1 of said fiber exhibits an abrasion resistance according to Martindale of between 30 000 and 60 000 tours up to the point of hole formation.

3. The fiber according to claim 1, wherein said fiber is produced from a mixture of at least two different pulps.

4. A fiber bundle comprising a plurality of fibers according to claim 1.

5. The fiber according to claim 1, wherein a single jersey 150 g/m2 produced from a ring yarn Nm 50/1 of said fiber exhibits an abrasion resistance according to Martindale of between 30 000 and 60 000 tours up to the point of hole formation.

6. The fiber according to claim 1, wherein said fiber is produced from a mixture of at least two different pulps.

7. A fiber bundle comprising a plurality of fibers according to claim 1.

8. The fiber according to claim 1, having a Höller factor F2≥2.

9. The fiber according to claim 1, wherein the Höller factor F2 minus 4.5*Höller factor F1≥3.

* * * * *